US011684815B2

(12) United States Patent
Larson et al.

(10) Patent No.: US 11,684,815 B2
(45) Date of Patent: Jun. 27, 2023

(54) QUICK RELEASE WEIGHT RETAINING SYSTEM

(71) Applicants: Joshua Lee Larson, Honolulu, HI (US); Adam Gregory Larson, Stafford, VA (US); Evan Scott Logue, Warrensburg, MO (US)

(72) Inventors: Joshua Lee Larson, Honolulu, HI (US); Adam Gregory Larson, Stafford, VA (US); Evan Scott Logue, Warrensburg, MO (US)

(73) Assignee: Joshua Lee Larson, Derby, KS (US)

( * ) Notice: Subject to any disclaimer, the term of this patent is extended or adjusted under 35 U.S.C. 154(b) by 113 days.

(21) Appl. No.: 17/212,991

(22) Filed: Mar. 25, 2021

(65) Prior Publication Data

US 2022/0305323 A1 Sep. 29, 2022

(51) Int. Cl.
*A63B 21/075* (2006.01)
*A63B 21/072* (2006.01)

(52) U.S. Cl.
CPC ..... *A63B 21/075* (2013.01); *A63B 21/0724* (2013.01); *A63B 21/0728* (2013.01)

(58) Field of Classification Search
CPC .. A63B 21/072–0783; A63B 21/00076; A63B 21/0609; A63B 2244/09; B66C 1/26
See application file for complete search history.

(56) References Cited

U.S. PATENT DOCUMENTS

| | | | | |
|---|---|---|---|---|
| 4,890,831 | A * | 1/1990 | Craig | A63B 21/0724 482/104 |
| 5,716,306 | A | 2/1998 | Gallay | |
| 5,749,814 | A | 5/1998 | Chen | |
| 7,052,445 | B2 | 5/2006 | Ekhaus | |
| 7,121,988 | B2 | 10/2006 | Walkerdine | |
| 7,153,243 | B1 | 12/2006 | Krull | |
| 7,201,711 | B2 | 4/2007 | Towley, III et al. | |
| 7,238,147 | B2 | 7/2007 | Mills et al. | |
| 7,588,520 | B2 | 9/2009 | Nalley | |
| 7,614,983 | B1 | 11/2009 | Krull | |
| 7,841,970 | B2 | 11/2010 | Striar et al. | |
| 8,485,946 | B2 | 7/2013 | Ross et al. | |
| 8,696,529 | B2 | 4/2014 | Krull | |
| 9,174,733 | B1 | 11/2015 | Burgess et al. | |
| 9,457,219 | B2 | 10/2016 | Smith | |

(Continued)

OTHER PUBLICATIONS

Product literature: Weight Releasers. PDF from: https://www.roguefitness.com/rogue-weight-releasers . Retrieved Mar. 15, 2021.

(Continued)

*Primary Examiner* — Loan B Jimenez
*Assistant Examiner* — Kathleen M Fisk

(57) ABSTRACT

Disclosed herein is a quick release weight retaining system configured to improve the safety and effectiveness of a resistance training routine. In an exemplary embodiment, the system includes a weight retainer that is removably mounted to a weight support member. The weight retainer includes an engaging apparatus that can retain and safely release a weight load during exercise. The weight is released by way of the exerciser activating a trigger. A weight can be safely and securely mounted to the weight retainer when pushed against the engaging apparatus.

20 Claims, 6 Drawing Sheets

(56) References Cited

U.S. PATENT DOCUMENTS

| | | | | |
|---|---|---|---|---|
| 9,944,366 | B2 * | 4/2018 | Tang | B64C 39/024 |
| 10,252,098 | B2 | 4/2019 | Wilke | |
| 10,807,834 | B2 | 10/2020 | Friessen | |
| 2016/0340006 | A1 | 11/2016 | Tang | |
| 2021/0331024 | A1 * | 10/2021 | Kwon | A63B 21/0728 |

OTHER PUBLICATIONS

Product literature: Ad-On Change Plate. PDF from: https://www.roguefitness.com/rogue-add-on-change-plate-pair . Retrieved Mar. 15, 2021.

* cited by examiner

QUICK RELEASE WEIGHT RETAINING SYSTEM

FIELD

The present invention relates to weight retaining systems. More particularly, the present invention relates to weight retaining systems configured to operatively release a weight by activation of a trigger.

BACKGROUND

Traditional weightlifting systems, such as weight stack-based systems, and free weight systems are commonly used in resistance training fitness regimes. Such resistance training regimes are used to enhance strength, muscle size and muscle density. Other significant benefits of weight-based resistance training include improved bone density, improved mobility, improved bodyweight management, and improved cardiovascular condition.

One method employed in weight-based resistance training regimes is commonly referred to as drop-setting. Drop-setting involves beginning a weightlifting "set" with a relatively heavy load, applied for example by mounting several barbell weight plates onto a barbell used for the particular exercise. During the set, the exerciser performs periodic repetitions of the lifting exercise, until the exerciser cannot perform an additional repetition. At that point during the set, a portion of the load is removed from the barbell so that the exerciser can perform additional repetitions with the reduced load. This sequence of repetitions and load reduction continues for as many cycles as the exerciser desires.

One inconvenience attendant to traditional drop-set execution is that there is an undesirable pause and interruption of the set at the point where the load must be reduced. For example, an additional participant or participants are required to be on hand to quickly strip weight from the barbell to ready it for the next group of repetitions to be performed by the exerciser. Alternatively, if the exerciser is alone, she or he must rack the barbell safely against the pull of gravity and strip the weights her or himself. This causes a particularly undesirably pause during the drop-set and disrupts the exerciser's overall rhythm and momentum. Additionally, this pause allows muscle recovery which negatively impacts the effectiveness of the drop-set.

An additional challenge attendant to resistance training arises in the case where free weights are used for exercises where the exerciser's body is positioned between the weight, such as a barbell, and the training floor. Such exercises include the bench press which requires the barbell to be pressed above the exerciser's face, neck, and chest area repeatedly in an up and down motion. A safety risk arises when the exerciser's muscles fatigue such that a press repetition can no longer be performed. If another participant is not on hand to assist the exerciser in racking the barbell safely against gravity, then the barbell may come to rest on the exerciser's chest, neck or face area potentially causing severe injury.

Similar risks arise in connection with the free weight barbell squat exercise, as another example. The squat is performed by resting the weight loaded barbell along the shoulders behind the neck. The exerciser bends at the knees and hips moving up and down perpendicular to the floor. If the exerciser finds her or himself in the lower position and has fatigued so as not to be able to rise to the standing position, the exerciser may be forced to simply drop the barbell down her or his back in an uncontrolled fashion. This too can lead to severe injury to the exerciser and those around them.

What is desirable is an innovative weight system that addresses these disruptions, inconveniences, and safety risks. Specifically, what is desirable is a system configured to permit the exerciser to safely reduce the load employed during exercise without requiring additional participants, without introducing an unwanted pause during the exercise, and without otherwise disrupting the rhythm of the exercise.

SUMMARY

An exemplary embodiment of the present invention comprises a quick release weight retaining system that comprises a first weight retainer removably mountable to a weight support member. The first weight retainer comprises a first engaging apparatus. The first engaging apparatus is configured to releasably retain a first weight. The exemplary system also includes a first trigger coupled to the first engaging apparatus configured to release the first weight when the trigger is activated.

In another exemplary embodiment, a quick release weight retaining system comprises a first weight retainer removably mountable to a weight support member. The first weight retainer comprises a first engaging apparatus. The exemplary embodiment also comprises a first weight configured to releasably engage the first engaging apparatus, and a first trigger coupled to the first engaging apparatus configured to release the first weight when the trigger is activated.

In another exemplary embodiment, a quick release weight retaining system comprises a first weight retainer mounted to a barbell. The first weight retainer comprises a first engaging apparatus. The first engaging apparatus is configured to releasably retain a first weight. A first trigger is coupled to the first engaging apparatus and is configured to release the first weight to a force of gravity when the trigger is activated, wherein the first weight falls away from the barbell upon release.

BRIEF DESCRIPTION OF DRAWINGS

These and other features, aspects, and advantages of the present invention will become better understood with regard to the following descriptions, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

So that the manner in which the features and advantages of embodiments of methods and systems of the present invention may be understood in more detail, a more particular description of the present invention briefly summarized above may be had by reference to certain embodiments thereof that are illustrated in the appended drawings, which form a part of this specification. The drawings illustrate only certain embodiments of the present invention and are, therefore, not to be considered limiting of the scope of the present invention which includes other useful and effective embodiments as well.

Figure 1:
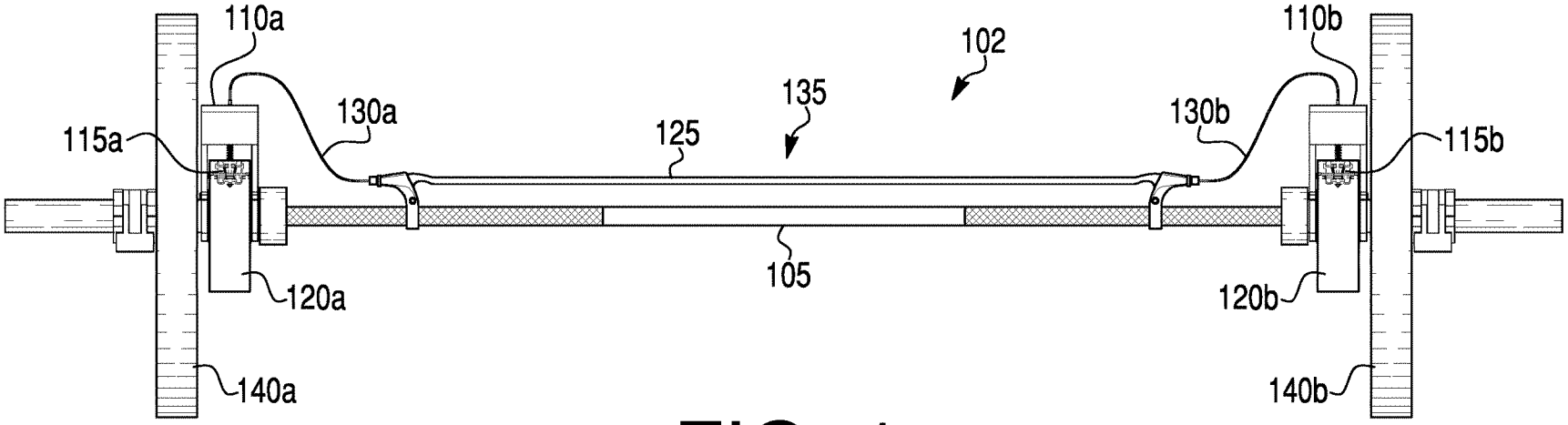
FIG. 1 is a side view of an exemplary quick release weight retaining system according to an exemplary embodiment of the present invention.

FIG. 1 is a side view of an exemplary quick release weight retaining system 102 according to the present invention. System 102 comprises a weight support member 105. In this exemplary embodiment, weight support member 105 comprises a standard Olympic weightlifting barbell. In alternate embodiments, weight support member 105 may be any apparatus the supports weight against gravity, including hand sized dumbbells, and other weight bearing devices used for resistance training.

FIG. 1 illustrates weight retainers 110*a* an 110*b* mounted to weight support member 105. In this exemplary embodiment weight retainers 110*a* and 110*b* may be fixedly mounted to weight support member 105, such as by way of fasteners or welding, as examples. Alternatively, in this exemplary embodiment, weigh retainers 110*a* and 110*b* may be removably mounted to weight support member 105, as will be described in more detail with reference to FIGS. 3, 4, 5 and 6.

Weight retainers 110*a* and 110*b* comprise engaging apparatus 115*a* and 115*b*, respectively. In this exemplary embodiment, engaging apparatus 115*a* and 115*b* are integral to weight retainers 110*a* and 110*b*, respectively. Details of exemplary embodiments of engaging apparatus 115*a* and 115*b* will be shown and described with reference to FIGS. 3 through 7.

FIG. 1 further illustrates weights 120*a* and 120*b* releasably engaged to, and retained by, engaging apparatus 115*a* and 115*b*, respectively. Engaging apparatus 115*a* and 115*b* retain weights 120*a* and 120*b* against the force of gravity, including during the repetitive movement of weight support member 105, for example during the execution of an exercise such the bench press.

FIG. 1 further illustrates trigger 125. In this exemplary embodiment, trigger 125 may be fixedly or removably coupled to weight support member 105. Trigger 125 is coupled to engaging apparatus 115*a* and 115*b*. In this exemplary embodiment, trigger 125 is coupled to engaging apparatus 115*a* and 115*b* by respective pull cables 130*a* and 130*b*. In this preferred embodiment, when trigger 125 is depressed in the direction indicated by arrow 135, pull cables 130*a* and 130*b* are pulled relative to engaging apparatus 115*a* and 115*b* respectively, thereby causing engaging apparatus 115*a* and 115*b* to release weights 120*a* and 120*b* to the force of gravity. In this exemplary embodiment, upon such release weights 120*a* and 120*b* fall away from weight support member 105. Such release thereby reduces the weight loaded to weight support member 105.

FIG. 1 further illustrates additional weights 140*a* and 140*b*. Additional weights 140*a* and 140*b*, and other such weights as desired, can be loaded to weight support member 105, that together with weights 120*a* and 120*b* sum to a starting load for an exerciser's exercise. At such time during the exercise as the exerciser desires, trigger 125 can be activated to release weights 120*a* and 120*b*, thereby reducing the load on weight support member 105. This reduction occurs in real time, during the exercise, without creating an undesirable pause during the exercise, and without requiring additional participants on hand to remove weights.

Figure 2:
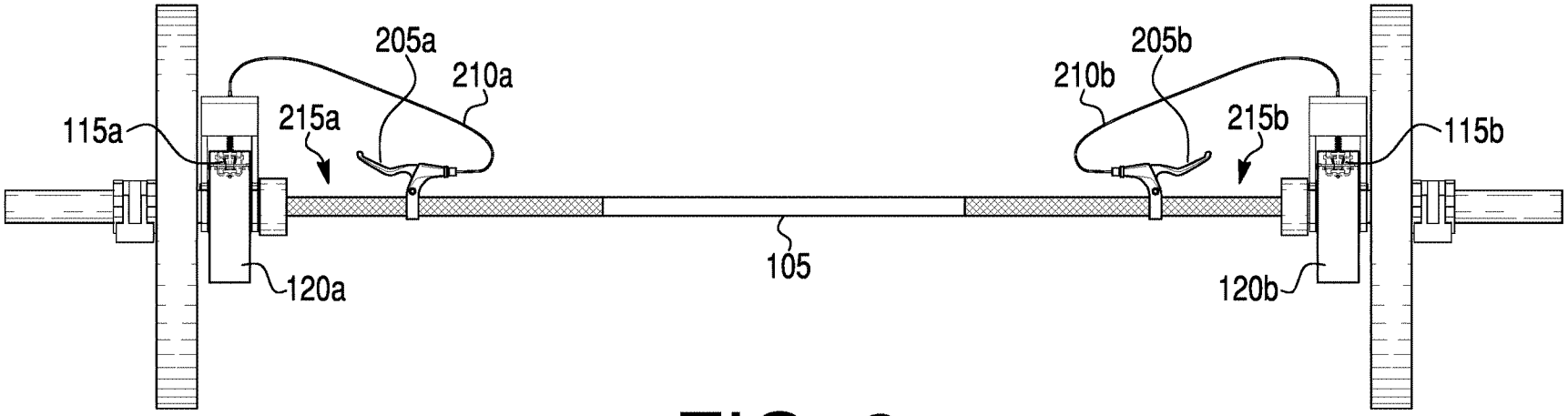
FIG. 2 is a side view of an exemplary quick release weight retaining system according to an exemplary embodiment of the present invention.

Turning to FIG. 2, FIG. 2 illustrates an alternative exemplary embodiment of the present invention. More specifically, FIG. 2 illustrates two independent triggers 205*a* and 205*b*. In this exemplary embodiment triggers 205*a* and 205*b* are coupled to engaging apparatus 115*a* and 115*b* by way of pull cables 210*a* and 210*b*, respectively. In this preferred embodiment, when triggers 205*a* and 205*b* are depressed in the direction indicated by arrows 215*a* and 215*b*, respectively, pull cables 210*a* and 210*b* are pulled relative to engaging apparatus 115*a* and 115*b* respectively, thereby causing engaging apparatus 115*a* and 115*b* to release weights 120*a* and 120*b* to the force of gravity. In this exemplary embodiment, upon such release weights 120*a* and 120*b* fall away from weight support member 105. Such release thereby reduces the weight loaded to weight support member 105.

In the preferred operation of this exemplary embodiment, triggers 205*a* and 205*b* are depressed simultaneously to release weights 120*a* and 120*b* at substantially the same time, thereby maintaining a balanced load, laterally, on weight support member 105. Separate triggers 205*a* and 205*b* may nevertheless be desirable under some circumstances. For example, when loading engaging apparatus 115*a* and 115*b* with weights 120*a* and 120*b*, it will sometimes be useful to release weight engagement as to one side or the other, without at the same time releasing weight engagement on the other side. For example, when both sides are loaded but it is determined that a different plate is desired for only one side, just that side can be released. In addition, separate triggers 205*a* and 205*b* may be a desirable configuration offering advantages for sales, distribution, and maintenance of the quick release weight retaining system. For example, a single bundle of components for only one side can be marketed when separate triggers are available. Additionally, a single trigger can be replaced in the event that only one side requires such maintenance.

Figure 3:
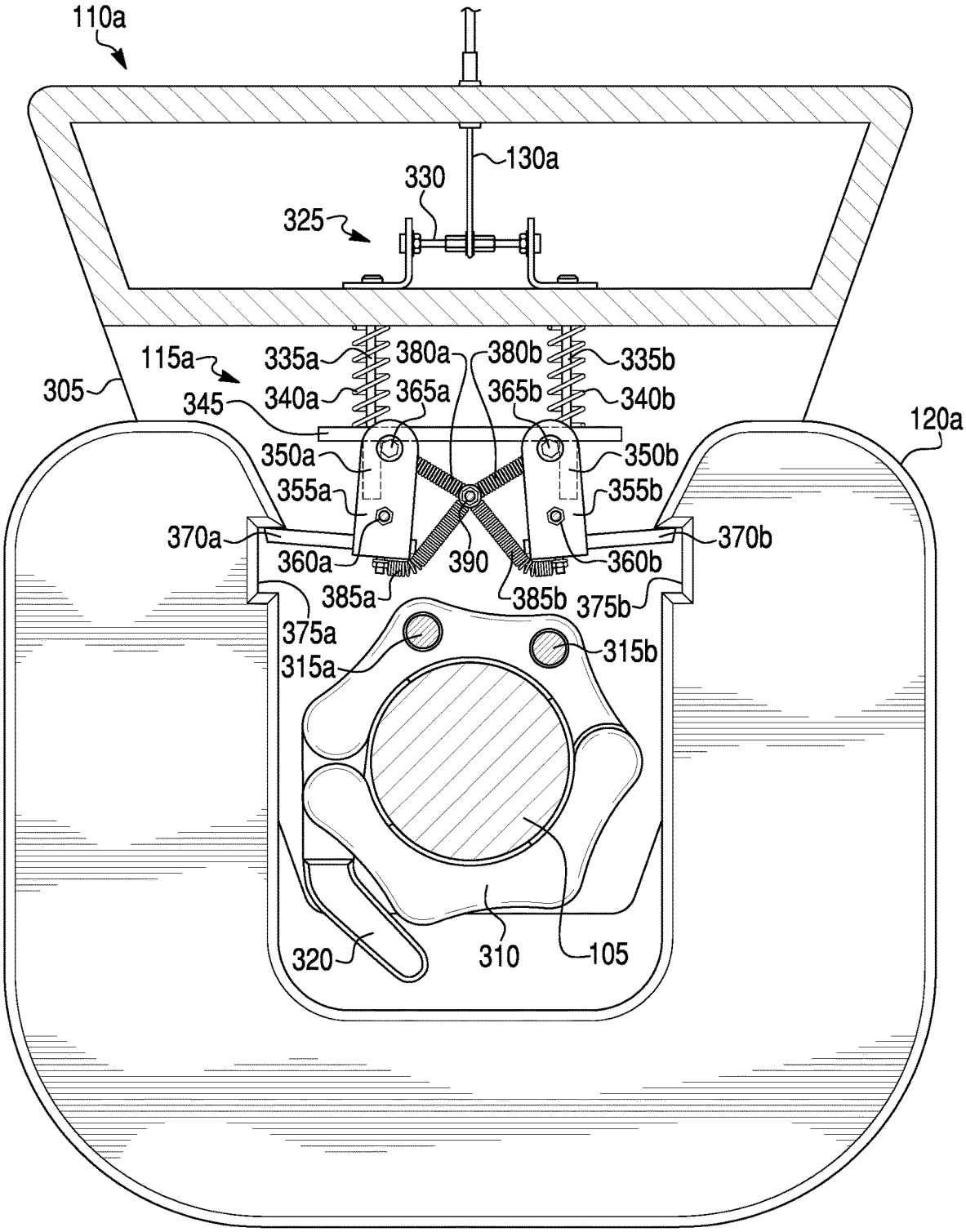
FIG. 3 illustrates a weight retainer and engaging apparatus according to an exemplary embodiment of the present invention.

Turning to FIG. 3, FIG. 3 illustrates a weight retainer and engaging apparatus, as well as other system components, according to one exemplary embodiment. More specifically, FIG. 3 illustrates detail of weight retainer 110*a*, engaging apparatus 115*a*, and weight 120*a*, as well as other system components. The system components, including the components of engaging apparatus 115*a* are identified and described with reference to FIG. 3, and FIG. 4. Details of their operation are described below with reference to FIGS. 5 through 7.

FIG. 3 is a cut-away side view of weight retainer 110*a*. Weight retainer 110*a* comprises rear sidewall 305. A front side wall is cut away and not shown, so that other system components including weight 120*a* and engaging apparatus 115*a* can be illustrated. Also shown is support member 105 in side cut-away view. Weight retainer 110*a* further comprises collar 310. Collar 310 is fixedly attached to rear wall 305 with fasteners, such as screws or bolts, 315*a* and 315*b*. Fully assembled, collar 310 is preferable similarly fixedly attached to a front wall of weight retainer 110*a* (not shown in FIG. 3) that opposes rear wall 305.

In this exemplary embodiment, Collar 310 serves to removably fix weight retainer 110*a* to support member 105.

More specifically, in FIG. 3 collar 310 is shown in a closed state. Collar 310 includes lever 320. When lever 320 is pressed inward towards collar 310, as shown in FIG. 3, collar 310 compresses around support member 105 so as to hold weight retainer 110*a* firmly on support member 105.

FIG. 3 further illustrates engaging apparatus 115*a*. Engaging apparatus 115*a* comprises support bracket 325. Support bracket 325 comprises cross beam 330. Cable 130*a* is coupled to crossbeam 330.

In this exemplary embodiment, engaging apparatus 115*a* further comprises lock pins 335*a* and 335*b*, surrounded by vertical springs 340*a* and 340*b*. Lock pins 335*a* and 335*b* extend through an elevating cross beam 345. Lock pins 335*a* and 335*b* each terminate in pin portions 350*a* and 350*b*, respectively (pin portions 350*a* and 350*b* shown in dotted line).

Engaging apparatus 115*a* further comprises swiveling brackets 355*a* and 355*b*. Swiveling brackets 355*a* and 355*b* comprise rotating bolts 360*a* and 360*b*, respectively. Rotating bolts 360*a* and 360*b* comprise fasteners, such as screws or bolts, which extend from rear wall 305, through brackets 355*a* and 355*b*, respectively, and when fully assembled, extend to the to a front wall of weight retainer 110*a*, not shown in FIG. 3.

In this exemplary embodiment, swiveling brackets 355*a* and 355*b* further comprise catch bolts 365*a* and 365*b*, respectively. Catch bolts 365*a* and 365*b* comprise fasteners, such as screws or bolts, which extend from one side of respective swiveling brackets 355*a* and 355*b*, to the other side of the respective brackets, as will be shown in more detail with reference to the view of FIG. 4.

Engaging apparatus 115*a* further comprises rotating catch plates 370*a* and 370*b*. Rotating catch plates 370*a* and 370*b* extend laterally from the bottom of swivel brackets 355*a* and 355*b*, respectively. Rotating catch plates 370*a* and 370*b* engage weight 120*a*. Specifically, weight 120*a* comprises engaging elements 375*a* and 375*b*, which in this exemplary embodiment are notches as shown. Rotating catch plates 370*a* and 370*b* support weight 120*a* against gravity by extending into engaging elements 375*a* and 375*b*, respectively. Swiveling brackets 355*a* and 355*b* are inhibited from rotating, which would otherwise permit weight 120*a* to fall away, because terminating pin portions 350*a* and 350*b* prevent catch bolts 365*a* and 365*b* from moving forward.

Engaging apparatus 115*a* further comprises upper tensions springs 380*a* and 380*b*, and lower tension springs 385*a* and 385*b*. Upper tensions springs 380*a* and 380*b* are attached at one end to catch bolts 365*a* and 365*b*, respectively, and at the other end to stationary bolt 390. In this exemplary embodiment, stationary bolt 390 comprises a fastener, such as a screw or bolt, extending from rear wall 305 to a front wall of weight retainer 110*a*, not shown in FIG. 3. Lower tensions springs 385*a* and 385*b* are attached at one end to the bottom of swiveling brackets 355*a* and 355*b*, respectively, and at the other end to stationary bolt 390.

Figure 4:
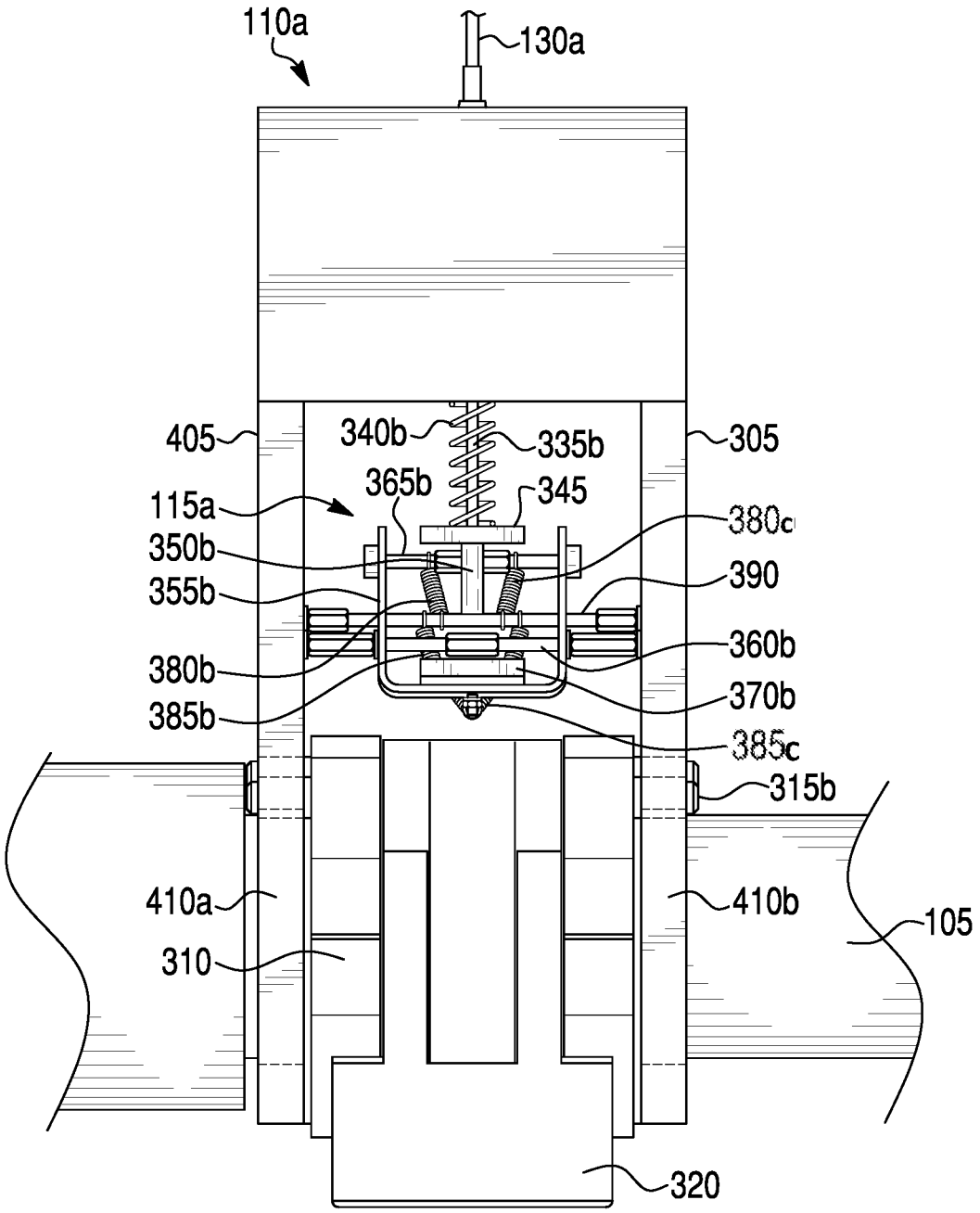
FIG. 4 illustrates a side view of a weight retainer illustrating detail of the mechanics of an engaging apparatus.

Turning to FIG. 4, FIG. 4 provides a side view illustrating detail of weight retainer 110*a*, engaging apparatus 115*a*, as well as other system components according to one exemplary embodiment. Specifically, FIG. 4 shows fully assembled weight retainer 110*a* removably mounted to support member 105. Weight retainer 110*a* includes both rear wall 305 and a front wall 405. The view of FIG. 4 is looking from the right side with reference to FIG. 3.

FIG. 4 illustrates cable 130*a* coupling into weight retainer 110*a*. Vertical spring 340*b* is shown surrounding lock pin 335*b*. Lock pin 335*b* terminates in pin portion 350*b*. Lock pin 335*b* extends through elevating cross beam 345.

Swiveling bracket 355*b* is rotatably mounted on rotating bolt 360*b*. Catch bolt 365*b* extends through the width of swivel bracket 355*b*. Rotating catch plate 370*b* is attached to the bottom of swiveling bracket 355*b*.

Upper tension spring 380*b*, and in this exemplary embodiment, an additional upper tension spring 380*c*, are attached at one end to catch bolt 365*b* and at the other end to stationary bolt 390. Lower tension spring 385*b*, and in this exemplary embodiment, an additional lower tension spring 385*c*, are attached at one end to the bottom of swiveling bracket 355*b*, and at the other end to stationary bolt 390.

FIG. 4 further illustrates collar 310 with lever 320 in the closed position so as to removably fix weight retainer 110*a* to support member 105. Additionally, FIG. 4 illustrates sidewall openings 410*a* and 410*b*, show by way of dotted lines, in front wall 405 and rear wall 305, respectively. In this exemplary embodiment, sidewall openings 410*a* and 410*b* are substantially circular in shape and aligned with the opening of collar 310 so as to facilitate the attachment and removal of weight retainer 110*a* to and from support member 105.

Figure 5:
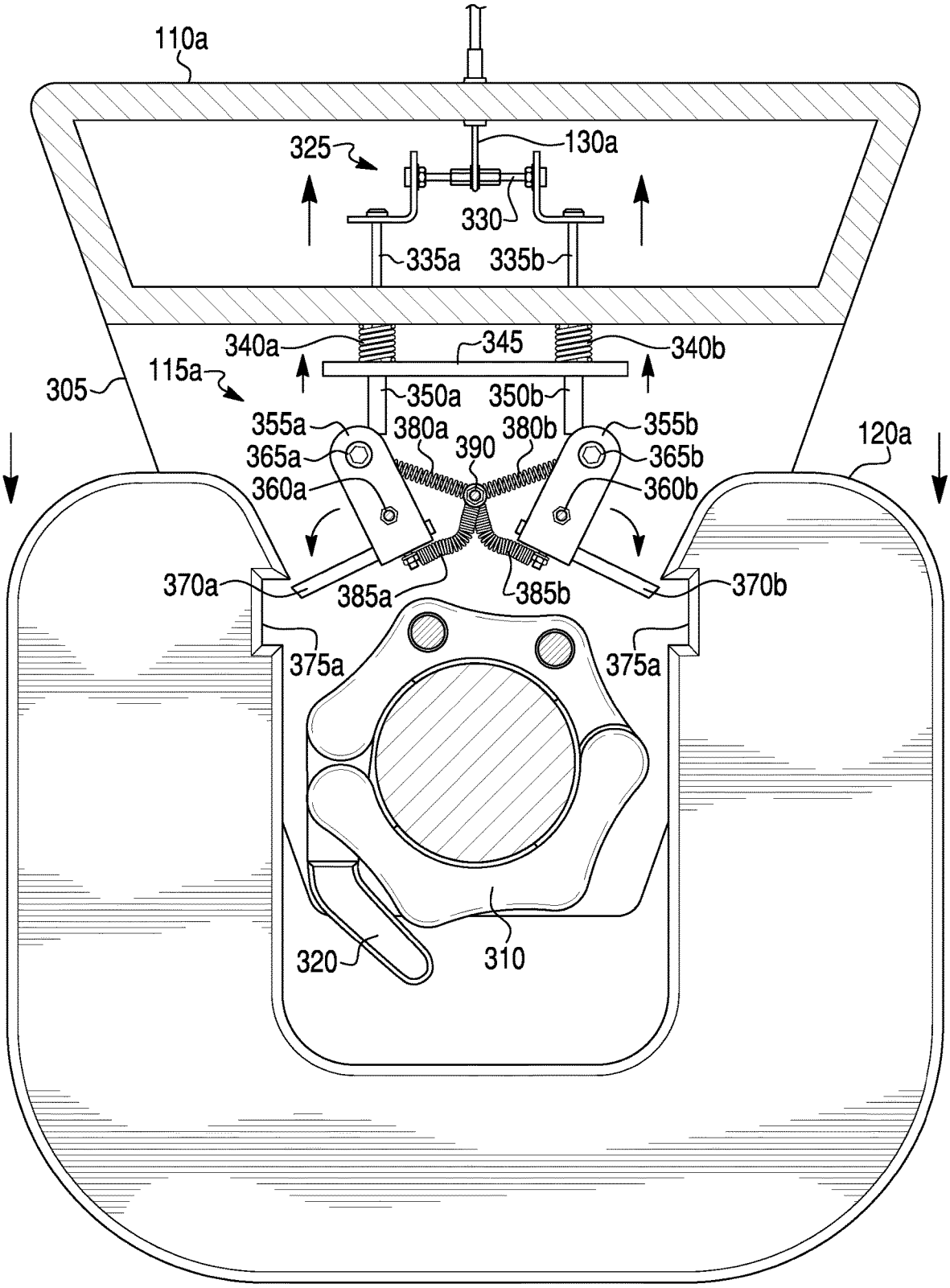
FIG. 5 illustrates a weight retainer and engaging apparatus releasing a weight, according to an exemplary embodiment of the present invention.

Turning to FIG. 5, FIG. 5 illustrates the releasing operation of one embodiment of the present invention. Specifically, when trigger 125 is depressed (FIG. 1), or similarly trigger 205*a* is depressed (FIG. 2), cable 130*a* is bulled upward, raising support bracket 325. Lock pins 335*a* and 335*b*, including pin portions 350*a* and 350*b* are moved upwards, along with elevating cross beam 345. Vertical springs 340*a* and 340*b* are compressed.

Pin portions 350*a* and 350*b* are thereby moved out of obstructing the forward motion of catch bolts 365*a* and 365*b*, respectively. Lower tension springs 385*a* and 385*b* urge the bottom of swivel brackets 355*a* and 355*b*, respectively, inward, thereby rotating brackets 355*a* and 355*b* around rotating bolts 360*a* and 360*b* respectively. This rotation causes rotating catch plates 370*a* and 370*b* to rotate out of engaging elements (notches) 375*a* and 375*b*, respectively, releasing weight 120 to the force of gravity.

Figure 6:
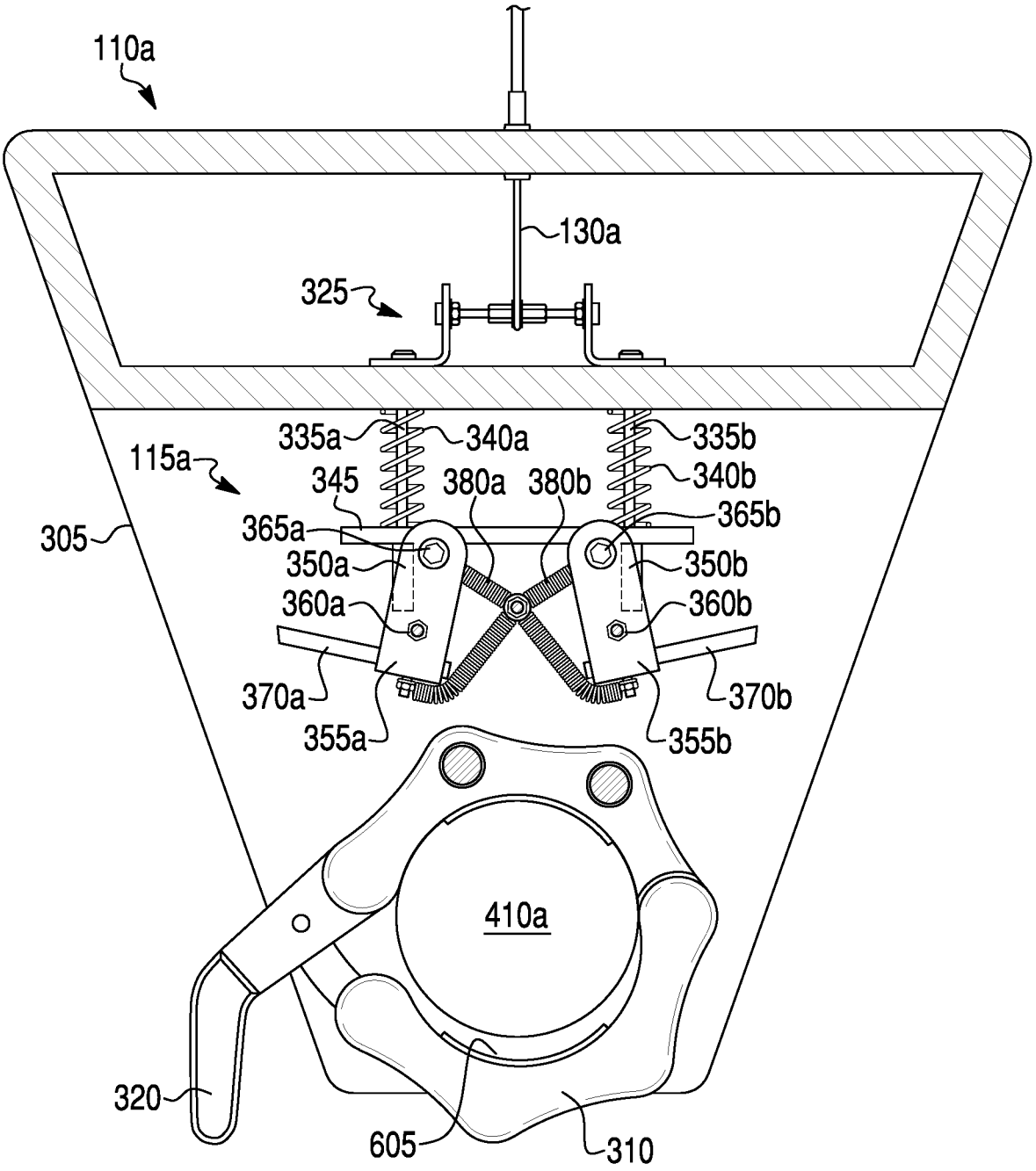
FIG. 6 illustrates a weight retainer and engaging apparatus without a weight engaged, according to an exemplary embodiment of the present invention.

FIG. 6 illustrates an exemplary embodiment of the present invention returned to an unloaded condition. More specifically, as illustrated in FIG. 6, upper tensions springs 380*a* and 380*b* have urged swiveling brackets 355*a* and 355*b*, respectively, inward, rotating around rotating bolts 360*a* and 360*b*, respectively. Furthermore, vertical springs 340*a* and 340*b* have urged lock pins 335*a* and 335*b*, including pin portions 350*a* and 350*b* downward, situating pin portions 350*a* and 350*b* so as to obstruct the forward movement of catch bolts 365*a* and 365*b*, respectively.

Additionally, FIG. 6 illustrates collar 310 in an open state. The open state is accomplished by moving lever 320 outward, which has the effect of increasing the diameter of a central opening 605 of collar 310. In this open state, according to particular embodiments, weight retainer 110*a* may be mounted on or removed from weight support member 105 (FIG. 1), which may be, in some examples, a traditional Olympic barbell.

Figure 7:
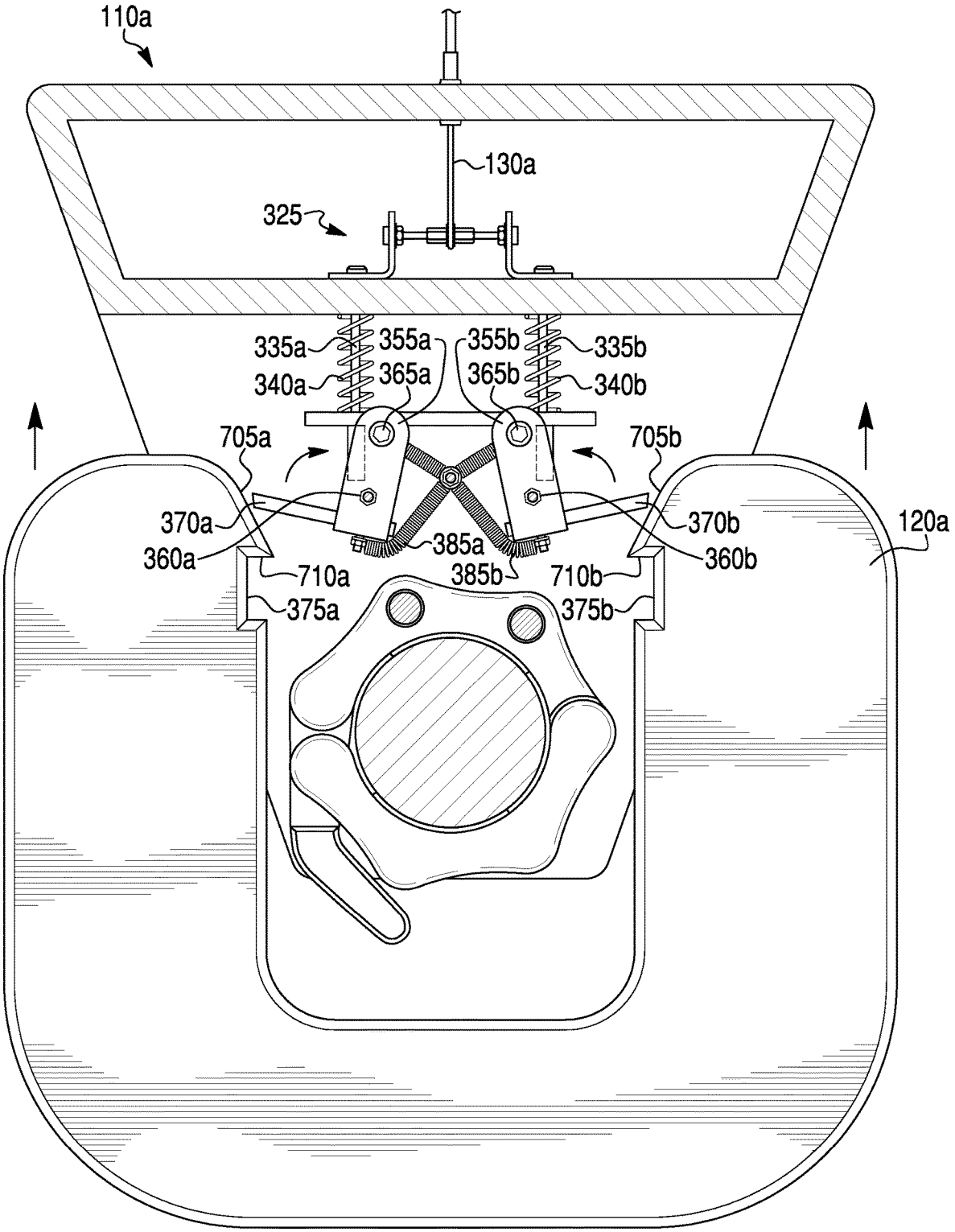
FIG. 7 illustrates a weight retainer and engaging apparatus receiving a weight, according to an exemplary embodiment of the present invention.

Turning to FIG. 7, FIG. 7 illustrates the operation of an exemplary embodiment of the present invention for engaging, or mounting, a weight to weight retainer 110*a*. More specifically, according to this embodiment, weight 120*a* is pushed upwards, contacting rotating catch plates 370*a* and 370*b*. In this exemplary embodiment, weight 120*a* comprises slanted surfaces 705*a* and 705*b*, which contract catch plates 370*a* an 370*b*. As catch plates 370*a* and 370*b* slide along surfaces 705*a* and 705*b*, respectively, swivel brackets

355*a* and 355*b* rotate around rotating bolts 360*a* and 360*b*, respectively, against a pulling force from lower tensions springs 385*a* and 385*b*, respectively.

In this exemplary embodiment, engaging elements 375*a* and 375*b* each comprise an upper lip 710*a* and 710*b*, respectively. When catch plates 370*a* and 370*b* traverse past upper lips 710*a* and 710*b*, respectively, catch plates 370*a* and 370*b* become situated inside engaging elements 375*a* and 375*b*, respectively. At that point, lips 710*a* and 710*b* rest on top catch plates 370*a* and 370*b*, respectively, as illustrated in FIG. 3. As a result, engaging apparatus 115*a* including catch plates 370*a* and 370*b* suspend weight 120*a* against gravity until released by activation of switch 125 (FIG. 1) or similarly by activation of switches 205*a* and/or 205*b* (FIG. 2).

Consequently, an innovative weight system is provided according to particular embodiments of the present invention that addresses disruptions, inconveniences, and safety risks attendant to conventional resistance training. Specifically, a system is provided permitting the exerciser to safely reduce the load employed during exercise without requiring additional participants, without introducing an unwanted pause during the exercise, and without otherwise disrupting the rhythm of the exercise.

The foregoing description of exemplary embodiments of the invention has been presented for the purpose of illustration; it is not intended to be exhaustive or to limit the invention to the precise forms disclosed. The description and drawings are, accordingly, to be regarded in an illustrative rather than a restrictive sense. The language used in the specification has been principally selected for readability and instructional purposes. It is therefore intended that the scope of the invention be limited not by this detailed description and drawings, but rather by any claims that issue based on this disclosure. It will be evident that various modifications and changes may be made thereto without departing from the broader spirit and scope of the invention as set forth in the claims.

What is claimed is:

1. A quick release weight retaining system comprising:

a first weight retainer removably mountable to a weight support member, the first weight retainer comprising a first engaging apparatus, the first engaging apparatus configured to releasably retain a first weight; and a first trigger coupled to the first engaging apparatus configured to release the first weight when the first trigger is activated.

2. The quick release weight retaining system of claim 1, further comprising a second weight retainer removably mountable to the weight support member, the second weight retainer comprising a second engaging apparatus, the second engaging apparatus configured to releasably retain a second weight.

3. The quick release weight retaining system of claim 2, the second engaging apparatus configured to release the second weight when the first trigger is activated.

4. The quick release weight retaining system of claim 2, further comprising a second trigger, the second engaging apparatus configured to release the second weight when the second trigger is activated.

5. The quick release weight retaining system of claim 1, wherein the first engaging apparatus is further configured to receive the first weight to retain the first weight when the first weight is pushed against the first engaging apparatus.

6. The quick release weight retaining system of claim 5, further comprising a collar configured to be in an open state and alternatively in a closed state, the collar substantially aligned with the opening, wherein, when the collar is set to the closed state, the collar facilitates fixing the first weight retainer to the weight support member.

7. The quick release weight retaining system of claim 1, wherein the first engaging apparatus is further configured to retain the first weight against a force of gravity during repetitive movement of the weight support member.

8. The quick release weight retaining system of claim 1, further comprising an opening in the first weight retainer, the opening being substantially circular in shape, the opening configured to facilitate the first weight retainer being slidably mounted to the weight support member.

9. A quick release weight retaining system comprising:

a first weight retainer removably mountable to a weight support member, the first weight retainer comprising a first engaging apparatus;

a first weight configured to releasably engage the first engaging apparatus;

a first trigger coupled to the first engaging apparatus configured to release the first weight when the first trigger is activated.

10. The quick release weight retaining system of claim 9, further comprising a second weight retainer removably mountable to the weight support member, the second weight retainer comprising a second engaging apparatus, the second engaging apparatus configured to releasably retain a second weight.

11. The quick release weight retaining system of claim 10, the second engaging apparatus configured to release the second weight when the first trigger is activated.

12. The quick release weight retaining system of claim 10, further comprising a second trigger, the second engaging apparatus configured to release the second weight when the second trigger is activated.

13. The quick release weight retaining system of claim 9, further comprising an opening in the first weight retainer, the opening being substantially circular in shape, the opening configured to facilitate the first weight retainer being slidably mounted to the weight support member.

14. The quick release weight retaining system of claim 13, further comprising a collar configured to be in an open state and alternatively in a closed state, the collar substantially aligned with the opening, wherein, when the collar is set to the closed state, the collar facilitates fixing the first weight retainer to the weight support member.

15. The quick release weight retaining system of claim 9, wherein the first weight comprises at least one engaging element configured to engage with the first engaging apparatus to retain the first weight against a force of gravity during repetitive movement of the weight support member.

16. The quick release weight retaining system of claim 9, wherein the first engaging apparatus is further configured to receive the first weight to retain the first weight when the first weight is pushed against the first engaging apparatus.

17. A quick release weight retaining system comprising:

a first weight retainer mounted to a barbell, the first weight retainer comprising a first engaging apparatus, the first engaging apparatus configured to releasably retain a first weight; and a first trigger coupled to the first engaging apparatus configured to release the first weight to a force of gravity when the first trigger is activated, wherein the first weight falls away from the barbell upon release.

18. The quick release weight retaining system of claim 17, wherein the first trigger is further configured to release a second weight from a second engaging apparatus to the force of gravity when the first trigger is activated, wherein the second weight falls away from the barbell upon release.

19. The quick release weight retaining system of claim 17, further comprising a second trigger coupled to a second engaging apparatus, the second trigger configured to release a second weight from the second engaging apparatus to the force of gravity when the second trigger is activated, wherein the second weight falls away from the barbell upon release.

20. The quick release weight retaining system of claim 17, wherein the first engaging apparatus is further configured to receive the first weight to retain the first weight when the first weight is pushed against the first engaging apparatus.

* * * * *